US005653011A

United States Patent [19]

Collins

[11] Patent Number: 5,653,011

[45] Date of Patent: Aug. 5, 1997

[54] FIXTURE FOR REPLACING A BEARING

[76] Inventor: Brian Edward Collins, 26466 Tollhouse Rd., Tollhouse, Calif. 93667

[21] Appl. No.: 523,799

[22] Filed: Sep. 5, 1995

[51] Int. Cl.[6] ..... B25B 27/14

[52] U.S. Cl. ..... 29/281.4; 29/281.5; 269/317; 269/319

[58] Field of Search ..... 29/898.07, 898.08, 29/281.1, 281.4, 256, 281.5; 269/47, 49, 317, 319, 315

[56] References Cited

U.S. PATENT DOCUMENTS

| | | | |
|---|---|---|---|
| 3,849,857 | 11/1974 | Murray, Jr. | 29/281.4 |
| 4,843,706 | 7/1989 | Luther et al. | 29/898.07 |
| 5,529,531 | 6/1996 | Kaiser, Jr. et al. | 451/307 |

FOREIGN PATENT DOCUMENTS

| | | | |
|---|---|---|---|
| 0267086 | 10/1990 | Japan | 29/281.4 |

*Primary Examiner*—S. Thomas Hughes
*Assistant Examiner*—Marc W. Butler
*Attorney, Agent, or Firm*—Daniel C. McKown

[57] ABSTRACT

For use in replacing a bearing in a machine that has a body, a shaft extending from the body, a bearing by which the shaft is mounted to the body, a wheel mounted on the shaft outside the body for rotation with the shaft, and a belt passing circumferentially around the wheel and exerting on the wheel a force that is perpendicular to the shaft, a fixture that includes a base, first means for attaching the base to the body of the machine, second means connected to the base for applying a counterforce to the wheel equal in magnitude and opposite in direction to the force exerted by the belt, and third means connected to the base for supporting the wheel in a fixed position with respect to the body of the machine after the counterforce has been applied and while the bearing is being replaced.

1 Claim, 2 Drawing Sheets

FIXTURE FOR REPLACING A BEARING

BACKGROUND OF THE INVENTION

1. Field of the Invention

The present invention is in the field of machinery and specifically relates to a fixture and a method of employing the fixture to replace a bearing that journals a shaft on which a belt wheel is mounted.

2. The Prior Art

Belts are typically used to bring power into a machine, to remove power from a machine, and to maintain synchrony between two rotating shafts. In the latter case, the belt may include transverse ribs that engage grooves on the circumference of the wheel. To avoid slipping of the belt with respect to the wheel and to avoid excessive sagging of the belt, it is necessary to maintain some tension in the belt. Indeed, if there were no tension in the belt, there could be no transmission of power.

Tension in the belt results in a sideward load applied to the bearings that journal the shaft to which the wheel is connected. This sideward load eventually causes wear of the bearing which eventually necessitates the replacement of the bearing.

Replacement of the beating, as practiced in the prior art, was not a simple matter, due mainly to the presence of the belt and the need to restore its original tension after the beating had been replaced. In some instances, especially those in which the present invention is most effectively employed, the wheel, the shaft and belt are heavy and may require several workers to position them. As a result, replacing the bearings was viewed as a difficult, time consuming, and possibly dangerous operation.

In a typical prior art practice, the belt was removed from the wheel to relieve sideward forces on the beating, then the wheel was removed from the shaft, and finally the shaft was removed from the bearing, after which the bearing was replaced and the parts were reassembled.

With these difficulties of the prior art method in view, the present inventor set out to find a more efficient way of replacing the bearings.

SUMMARY OF THE INVENTION

It is a first objective of the present invention to provide a simpler and less time consuming method for replacing the bearings that journal the shaft of a belt wheel.

A second objective of the present invention is to provide an apparatus that permits the bearings to be replaced without having to remove the belt wheel or the belt from the machine and in which it is not necessary to reestablish the tension in the belt.

In accordance with the present invention, these objectives are met by providing a fixture that attaches to the body of the machine and that holds the wheel and the belt in substantially their original positions while the bearings are being replaced.

In accordance with the present invention, a fixture is provided that includes tensioning bolts for applying to the wheel a force that counter-balances the force applied by the belt so as to relieve the sideward loading of the bearings, thereby facilitating their replacement by decreasing the friction between the bearing and the shaft.

In accordance with the present invention, the fixture further includes clamping means for holding the wheel in substantially its original position after the belt tension has been counter-balanced, while the bearings are being replaced.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
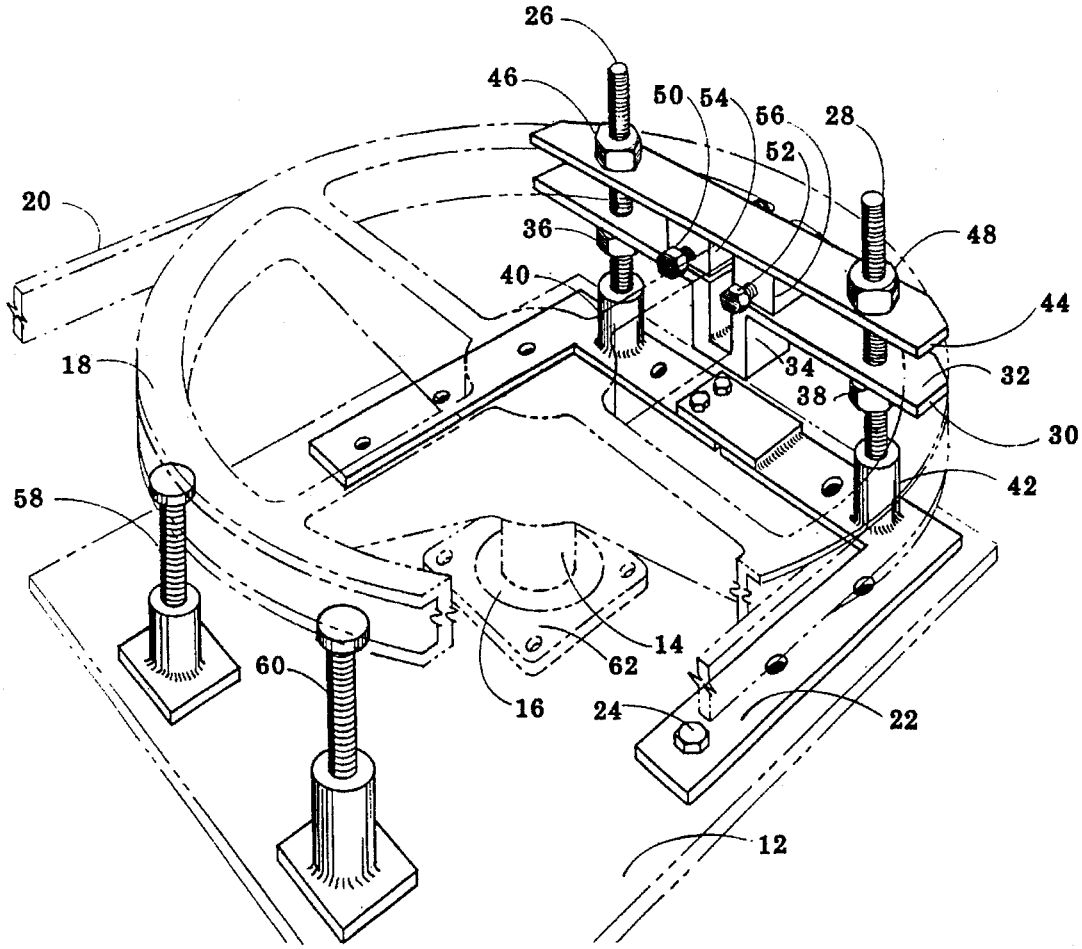
FIG. 1 is a perspective view showing the fixture of the present invention in use, and with the belt, the wheel, the shaft, and the bearings shown in phantom lines.
Figure 3:
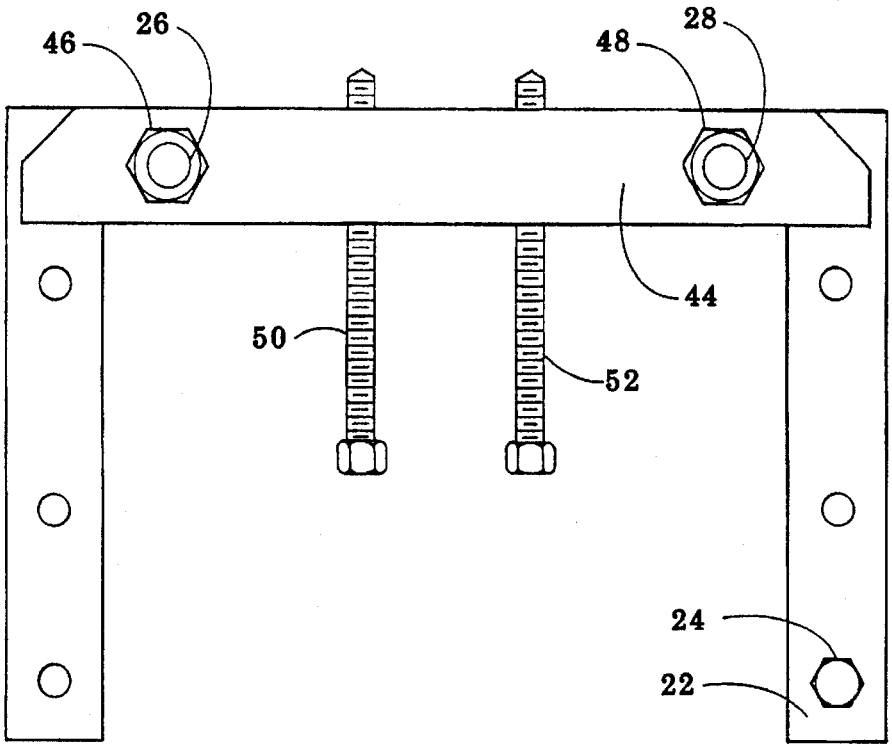
FIG. 3 is a top plan view of the fixture of FIG. 1.
Figure 2:
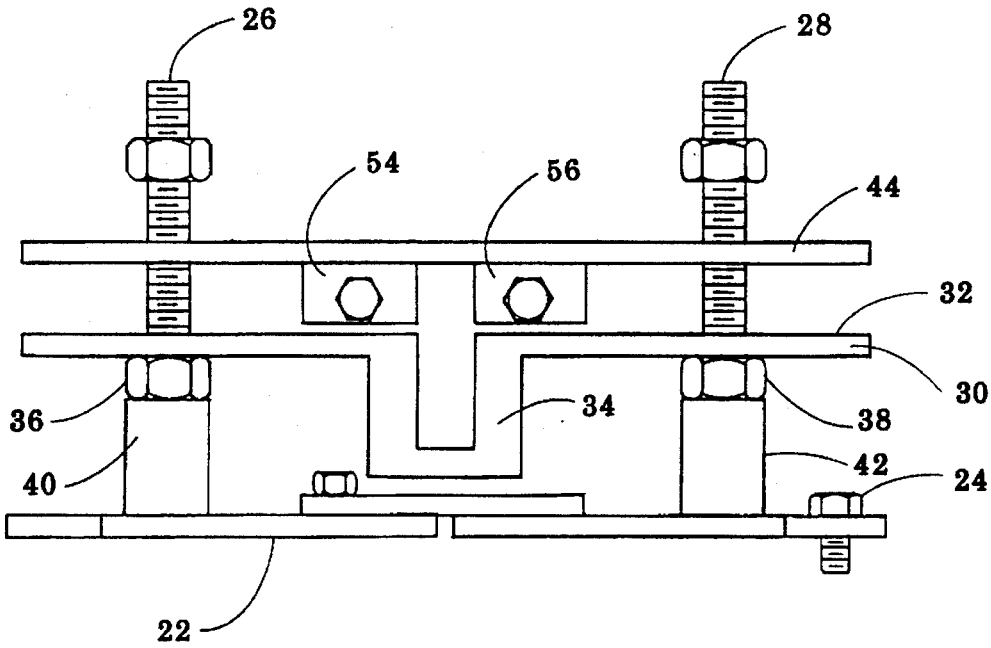
FIG. 2 is an end elevational view of the fixture of FIG. 1.

FIG. 1 shows the fixture of the present invention mounted on the body 12 of a machine and in use. The machine includes a shaft 14 that is journaled in a bearing 16, and further includes a wheel 18 that is attached to the shaft 14 for rotation with it. The wheel 18 is driven by the belt 20 or alternatively, the wheel may drive the belt. These parts of the machine are no part of the present invention and therefore they are shown in dashed lines.

The purpose and type of the machine are not relevant to the present invention.

The fixture of the present invention includes a base 22 that is attached to the body of a machine by bolts of which the bolt 24 is typical. The holes in the base through which the bolt 24 pass may be located to coincide with existing holes in the body 12, or it may be necessary to bore a number of holes in the body of the machine specifically for the purpose of mounting the base 22. Note that the base 22 and the bolts 24 fit between the body 12 of the machine and the wheel 18.

A lower plate 30 includes clearance holes through which the studs 26 and 28 are passed after the base 22 has been secured to the body 12 of the machine. The lower plate 30 is moved upward into a position where its upper surface 32 is in contact with the surface of the wheel 18 that faces the body 12 of the machine. The lower plate, in a preferred embodiment, includes a generally U-shaped center portion 34 that fits around one of the spokes of the wheel 18. The lower plate also includes the blocks 54 and 56 that have threaded holes for receiving the tensioning bolts 50 and 52. With the upper surface 32 in contact with the wheel 18, and with the nuts 36 and 38 manually held between the lower plate 30 and the base 22, the studs 26 and 28 are inserted down through the clearance holes in the lower plate 30, and are screwed through the nuts 36 and 38 and into the threaded sockets 40 and 42. After the studs have been screwed all the way into the threaded sockets 40 and 42, the nuts 36 and 38 are advanced along the studs to snug the lower plate 30 into contact with the wheel 18.

Next, the free ends of the studs 26 and 28 are inserted through clearance holes in the upper plate 44 so that the lower surface of the upper plate 44 bears against the wheel 18. The upper plate 44 is then secured in this position by the nuts 46 and 48.

Further adjustment of the nuts 36, 38, 46 and 48 brings the upper and lower plates 30 and 44 respectively into a loose sliding fit against the wheel 18, so that the parts occupy the positions shown in FIG. 1. The bolts 50 and 52 extend completely through the blocks 54 and 56 so as to bear against the inside concave surface of the rim of the wheel 18.

With the fixture in this position, the bolts 50 and 52 are advanced into the threaded bores in the blocks 54 and 56, and at some point the bolts 50 and 52 begin to exert a sideward thrust on the wheel 18. The bolts 50 and 52 are further turned until the force exerted by them on the wheel is approximately equal in magnitude and opposite in direction to the force exerted on the wheel by the belt 20. When the counterforce applied by the bolts 50 and 52 to the wheel equals the force exerted on the wheel by the belt 20, the sideward load on the bearing 16 is zero, which greatly facilitates replacement of the bearing.

After the force exerted by the belt has been counterbalanced by the force exerted by the bolts 50 and 52, the nuts 36 and 38 are turned to push the lower plate 30 into tight contact with the lower side of the wheel 18, and the nuts 46 and 48 are turned to draw the upper plate 44 into tight contact with the upper surface of the wheel 18. Thereafter, the jacks 58 and 60 are slid into position on the body 12 of the machine and are extended into tight contact with the lower surface of the wheel 18. The jacks 58 and 60 permit the wheel 18 to be supported on both sides of its center, so that the weight of the wheel does not result in a side load on the bearing.

With the wheel thus supported, the shaft 14 may be withdrawn from the wheel, and the bearing mounting plate 62 may be unscrewed from the body 12, permitting the bearing to be removed from the shaft and replaced by a new bearing.

From the above description, it can be appreciated that the key to success of the present invention lies applying a counterforce to the wheel to cancel the force exerted by the belt, thereby relieving sideward loads on the bearing; otherwise, the sideward load on the bearing would make it very difficult to remove the bearing from the shaft 14.

After the bearing has been replaced, the shaft is replaced in the wheel, and then the bolts are unscrewed and the fixture is removed from the machine.

Thus, there has been described a fixture and a method that facilitate the changing of bearings that journal a shaft that extends from the body of a machine.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A fixture for use in performing maintenance on a machine, said machine having a body, a shaft extending from the body, a bearing by which the shaft is mounted to the body, a wheel mounted on the shaft outside the body for rotation with the shaft, and a belt passing circumferentially around the wheel and exerting on the wheel a force that is perpendicular to the shaft, said fixture used for replacing the bearing and comprising in combination:

a base;

first means for attaching said base to the body of the machine;

second means connected to said base for applying a counterforce to the wheel in a direction opposite to the direction of the force exerted by the belt and equal in magnitude so as to counterbalance the force exerted by the belt; and, third means connected to said base for securely supporting the wheel in a fixed position with respect to the body after the counterforce has been applied and while the bearing is being replaced.

* * * * *